US005462309A

United States Patent [19]

Jeffers et al.

[11] Patent Number: 5,462,309

[45] Date of Patent: Oct. 31, 1995

[54] STACKABLE COUNTERWEIGHT ARRANGEMENT

[75] Inventors: Scott E. Jeffers, Clayton; David B. Frankel, Cary, both of N.C.

[73] Assignee: Caterpillar Inc., Peoria, Ill.

[21] Appl. No.: 247,186

[22] Filed: May 20, 1994

[51] Int. Cl.[6] ..... E02F 9/18

[52] U.S. Cl. ..... 280/759; 212/195; 293/117; 414/719; 187/222

[58] Field of Search ..... 414/719, 673; 293/117; 212/195, 178; 280/759, 757, 758; 187/404, 405, 222

[56] References Cited

U.S. PATENT DOCUMENTS

| | | | |
|---|---|---|---|
| 745,203 | 11/1903 | Latta . | |
| 1,544,758 | 7/1925 | Hulett et al. | 414/673 X |
| 2,187,262 | 1/1940 | Brown | 97/55 |
| 3,003,785 | 10/1961 | Straszheim et al. | 280/759 |
| 3,032,352 | 5/1962 | Barrett | 280/150 |
| 3,061,034 | 10/1962 | Hoyt | 180/68.5 |
| 3,416,814 | 12/1968 | Martin | 280/150 |
| 3,490,787 | 1/1970 | Latterman et al. | 280/150 |
| 3,533,524 | 10/1970 | Wilcox | 414/719 |
| 3,635,493 | 1/1972 | Barth et al. | 280/150 |
| 3,853,231 | 12/1974 | Luttrell | 214/142 |
| 4,580,811 | 4/1986 | Wykhuis et al. | 280/759 |
| 4,664,404 | 5/1987 | Schultz | 280/461 |
| 4,688,823 | 8/1987 | Hanses | 280/759 |
| 5,219,180 | 6/1993 | Zipser et al. | 280/759 |

FOREIGN PATENT DOCUMENTS

| | | | |
|---|---|---|---|
| 1456887 | 12/1968 | Germany | 414/719 |
| 151472 | 9/1982 | Japan | 280/759 |

*Primary Examiner*—Donald W. Underwood
*Attorney, Agent, or Firm*—Calvin E. Glastetter

[57] ABSTRACT

Counterweights are useful in stabilizing a work machine to increase the traction to a pair of wheels on one end when a implement is attached to the opposite end of the machine. The subject counterweight arrangement includes a base weight which is removably attached to the machine frame. A plurality of add-on weights are removably attached beneath the base weight by a u-shaped bolt. This arrangement of components provides a simple compact structure to counteract the weight of the implement attached to the opposite end of the machine and also provides a way to add or subtract weight to offset the the addition or subtraction of mechanisms to the end of the backhoe stick assembly.

2 Claims, 4 Drawing Sheets

64
60
87
68
12
76
74
70
72
66
77
83
85
78
82
80
84
62
62
86

STACKABLE COUNTERWEIGHT ARRANGEMENT

TECHNICAL FIELD

This invention relates to a counterweight arrangement for a work machine and more particularly to an arrangement wherein a plurality of weights can be attached below a base unit which is mounted to a machine frame.

BACKGROUND ART

Counterweights are used on machines to improve traction and stability by holding the front end of the machine more stable when using a backhoe mechanism and during roading and maneuvering of the machine. One problem associated with adding counterweights to a work machine is that the weights could be difficult to attach or maintain in proper position to counteract movement of the backhoe mechanism or to maintain good roadability, Backhoe loaders can also support the use of a variety of different mechanisms that may attach to the end of the backhoe stick and replace the backhoe bucket. As different mechanisms are attached and removed the machine front to rear balance may suffer.

The present invention is directed to overcoming one or more of the problems as set forth above.

DISCLOSURE OF THE INVENTION

In the present invention a counterweight arrangement is adapted to be mounted on a frame of a machine. The counterweight arrangement includes a first weight which is removably attached to the machine frame. A first means is provided for attaching the first weight to the machine frame. A second weight is removably attached underneath the first weight. A second means is provided for attaching the second weight to the first weight.

The present invention provides a counterweight arrangement which can be used to add additional weight beneath a base weight which is attached to the front frame of a machine to improve stability and performance.

BEST MODE FOR CARRYING OUT THE INVENTION

Figure 1:
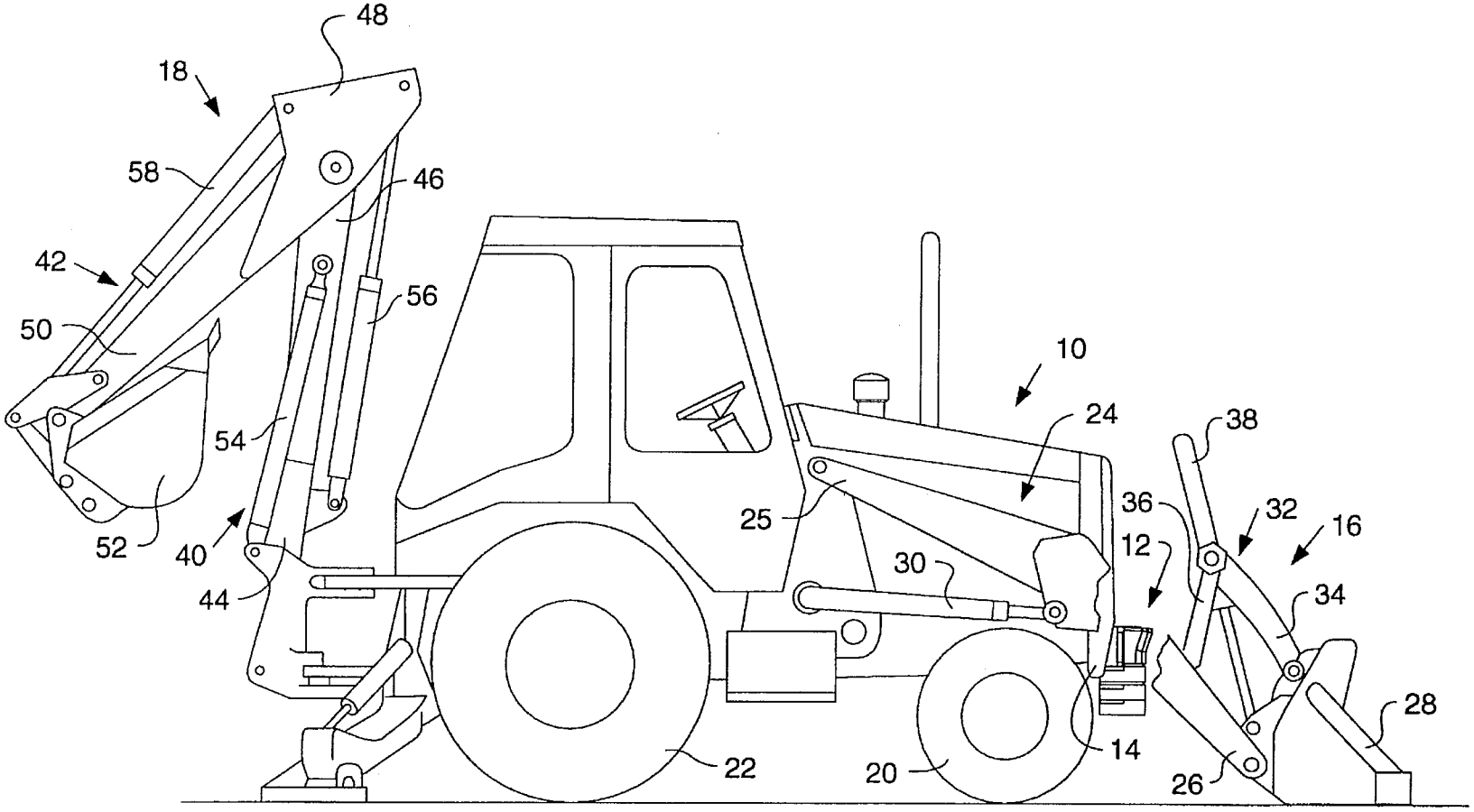
FIG. 1 is a right side view of a machine showing the position of the counterweight arrangement.

Referring to FIG. 1, a work machine 10, such as a backhoe loader, includes a stackable counterweight arrangement 12 attached to a front frame 14 of the work machine 10.

The work machine 10 includes a loading mechanism 16 attached to the front of the machine and a backhoe mechanism 18 attached to the rear of the machine 10. The machine 10 has a pair of front wheels 20 and a pair of rear wheels 22.

The loading mechanism 16 includes a lift arm 24 having a first end 25 pivotally connected to the machine 10 and a second end 26 extending therefrom forwardly in front of the machine 10. A bucket 28 is pivotally attached to the second end 26 of the lift arm 24. A hydraulic lift cylinder 30 is attached between the machine 10 and the lift arm 24 to pivotally move the lift arm 24. A tilt mechanism 32 is connected between the bucket 28 and the lift arm 24. The tilt mechanism 32 includes a first link 34 connected to the bucket 28, a second link 36 connected to the lift arm 24 and a hydraulic tilt cylinder 38 connected between the bucket 28 and the first and second links 34, 36.

The backhoe mechanism 18 includes a boom assembly 40 and a stick assembly 42. The boom assembly 40 has a first end 44 pivotally attached to the machine 10 and a second end portion 46 extending therefrom. The stick assembly 42 has a first end portion 48 pivotally attached to the second end portion 46 of the boom assembly 40 and a second end portion 50 extending therefrom. A bucket 52 is pivotally attached to the second end portion 46 of the stick assembly 42. A hydraulic boom cylinder 54 is connected between the machine 10 and the boom assembly 40. A hydraulic stick cylinder 56 is connected between the boom assembly 40 and the first end portion 48 of the stick assembly 42. A hydraulic bucket cylinder 58 is connected between the first end portion 48 of the stick assembly 42 and the bucket 52.

Figure 2:
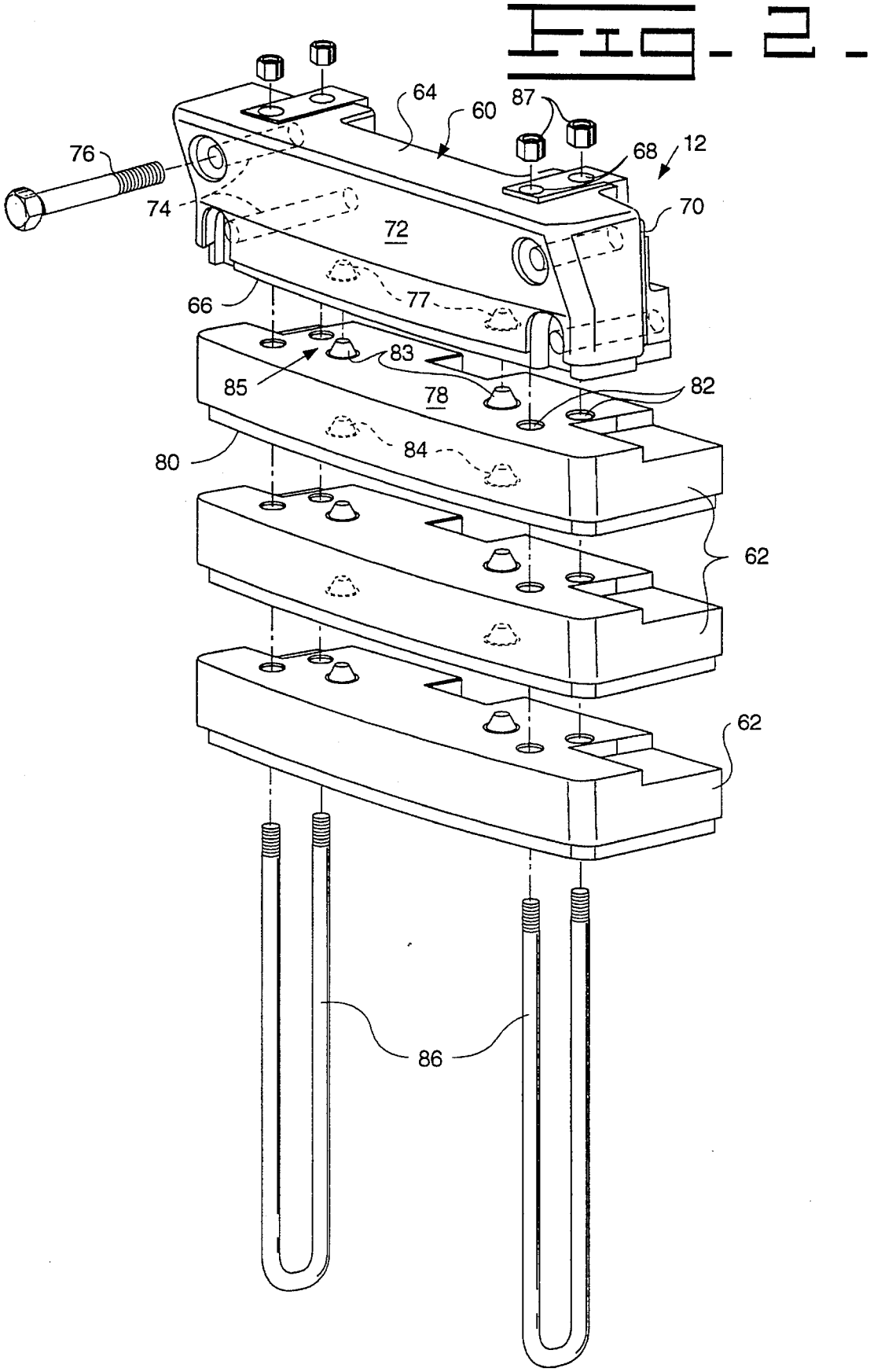
FIG. 2 is an exploded view of the counterweight arrangement.
Figure 3:
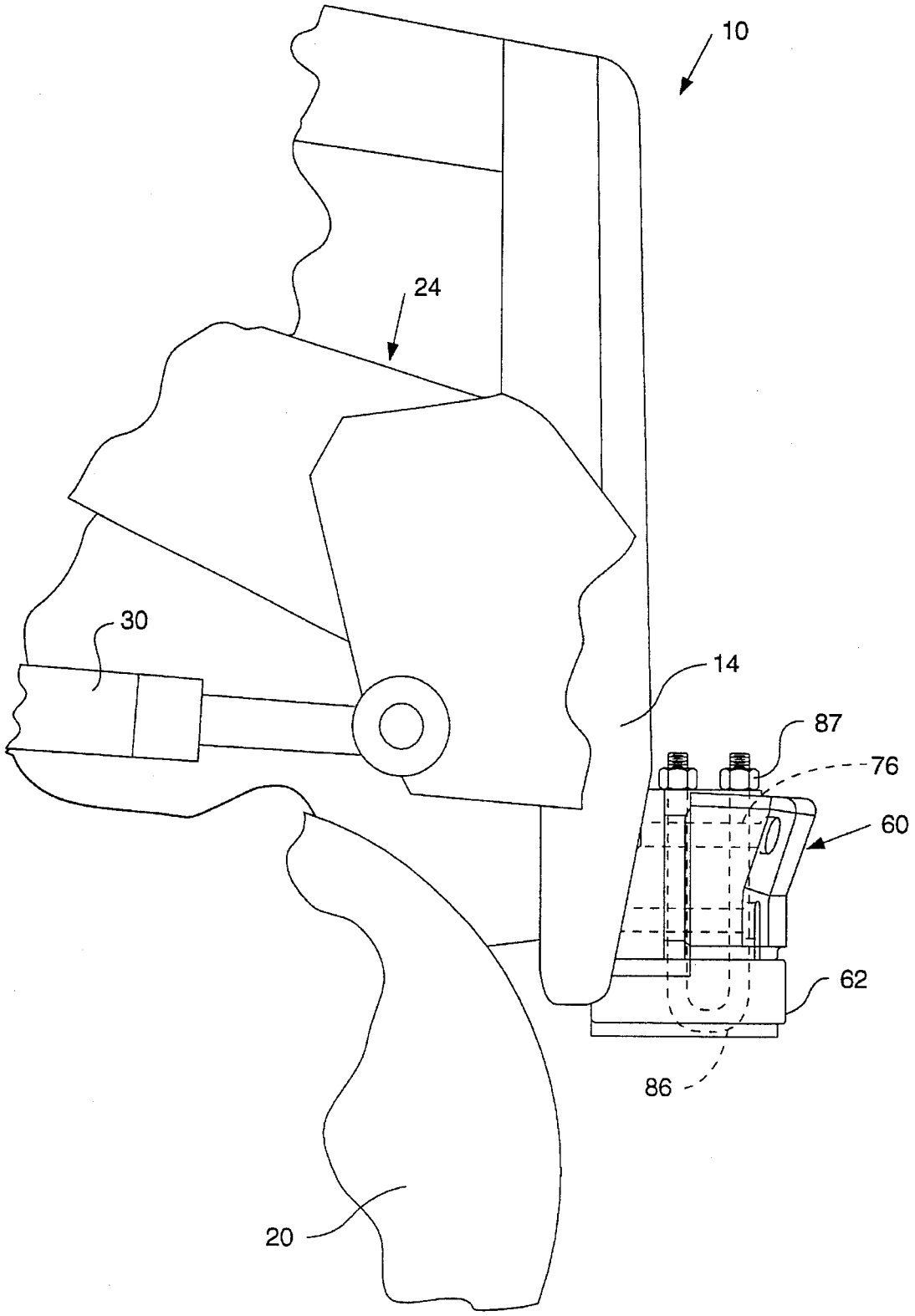
FIG. 3 is an enlarged side view showing a single add-on weight.
Figure 4:
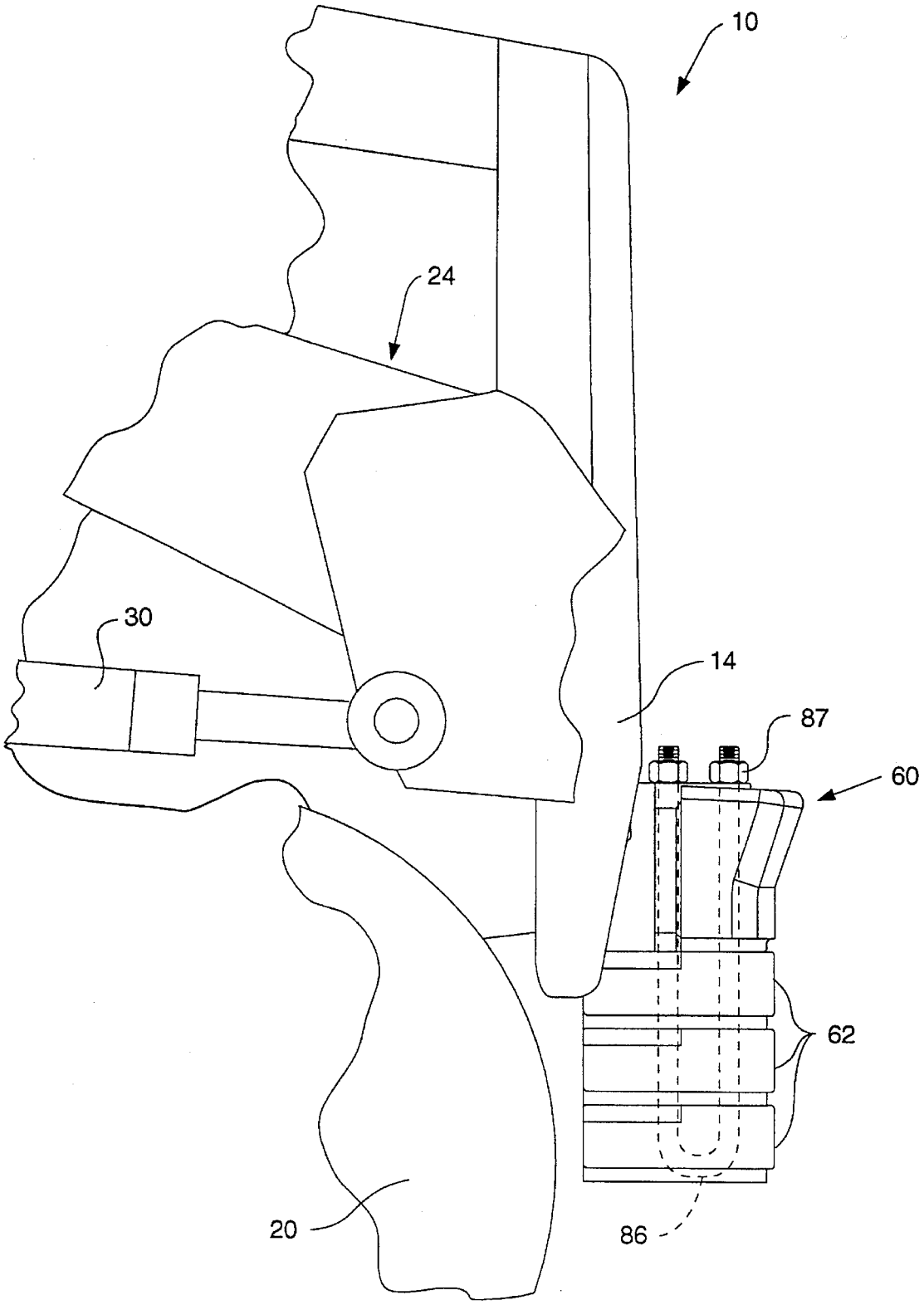
FIG. 4 is an enlarged side view showing a plurality of add-on weights.

As best shown in FIG. 2, the stackable counterweight arrangement 12 includes a first or base weight 60 and a plurality of add-on weights 62 which can be mounted subjacent the base weight 60. The base weight 60 is rectangular in construction and includes an upper surface 64 and a lower surface 66 with a plurality of vertically extending holes 68 therebetween. The base weight 60 further includes a first side surface 70 and a second side surface 72 with a plurality of horizontally extending holes 74 therebetween. A first means, in this application a bolt 76, is provided for attaching the base weight 60 to the machine frame 14. The bolt 76 passes through the horizontal holes 74 in the base weight 60 and is threadably fastened to the frame 14. A plurality of cone-shaped depressions 77 are formed in the lower surface 66.

Each weight, of the plurality of add-on 10 weights 62, is identical therefore only one weight will be described in detail. The weight 62 is rectangular in construction and includes an upper surface 78 and a lower surface 80 with a plurality of vertically extending holes 82 therebetween. A plurality of cone-shaped projections 83 are formed on the upper surface 78 for interacting with the cone-shaped depressions 77 of the base weight 60. A plurality of cone-shaped depressions 84 are formed in the lower surface 80 to interact with corresponding cone-shaped projections 83 of adjacent weights. The cone-shaped depressions 77, 84 and the cone-shaped projections 83 form a means 85 for positioning and locating the weights 60, 62 for assembly. The means 85 in this application is shown as being cone-shaped, however, any suitable shape can be used.

A second means, in this instant application a u-shaped bolt 86, is provided for attaching the add-on weight 62 to the base weight 60. Any suitable fastening means can be used in place of the u-shaped bolt without departing from the invention. The u-shaped bolt 86 passes through the holes 82 of the add-on weight, the holes 68 of the base weight and extends above the upper surface 60 a predetermined distance. A nut 87 is threadably fastened to the extending portion and is tightened to hold the add-on weights 62 in position below the base weight 60.

Industrial Applicability

In the use of the present invention the work machine 10 includes a front frame 14. The base weight 60 of the counterweight arrangement 12 is removably attached to the front frame 14. The bolt 76 is inserted to extend through the horizontal holes 74 in the base weight 60 and is threadably fastened to the front frame 14. The add-on weight 62 is positioned underneath the base weight 60. If more weight is needed additional add-on weights 62 can be added below the other weights. The u-shaped bolt 86 is inserted to extend through the vertical hole 82 in the add-on weight 62 and the vertical hole 68 of the base weight 60. The u-shaped bolt 86 will extended upwardly beyond the upper surface 64 of the base weight 60. The nut 87 is threadably fastened to the extending portion of the u-shaped bolt 86. The nut 87 is tightened until the add-on weights 62 are pulled upwardly to contact the base weight 60. A different length u-shaped bolt 86 is used for corresponding numbers of add-on weights 62.

In view of the forgoing, it is readily apparent that the structure of the present invention provides a counterweight arrangement which provides a compact construction of components and a simple and low cost way of attaching add-on weights beneath a base weight.

Other aspects, objects and advantages of this invention can be obtained from a study of the drawings, the disclosure and the appended claims.

We claim:

1. A counterweight arrangement adapted to be mounted on a frame of a machine, comprising:

a first weight having first and second side surfaces and upper and lower surfaces with a plurality of first mounting holes extending vertically therebetween, and a plurality of second mounting holes extending horizontally between the first and second side surfaces;

a plurality of first attaching means adapted to extend through said plurality of second mounting holes and releasably connect said first weight to the frame of the machine;

a second weight having upper and lower surfaces with a plurality of mounting holes extending vertically between said upper and lower surfaces; and a plurality of second attaching means adapted to extend through said mounting holes in said second weight and through said first mounting holes in said first weight and connect said second weight subjacent and to said first weight.

2. A counterweight arrangement, as set forth in claim 1, wherein said second weight includes a plurality of substantially similar weights.

* * * * *